United States Patent [19]

Petersen

[11] Patent Number: 5,033,942

[45] Date of Patent: Jul. 23, 1991

[54] PERISTALTIC VOLTAGE BLOCK ROLLER ACTUATOR

[75] Inventor: Eric A. Petersen, Indianapolis, Ind.

[73] Assignee: Ransburg Corporation, Indianapolis, Ind.

[21] Appl. No.: 501,547

[22] Filed: Mar. 30, 1990

[51] Int. Cl.[5] ..... B05B 5/02

[52] U.S. Cl. ..... 417/477; 251/6

[58] Field of Search ..... 417/477, 475; 251/6

[56] References Cited

U.S. PATENT DOCUMENTS 4,702,679 10/1987 Malber ..... 417/477 X
4,720,249 1/1988 Krebs et al. ..... 417/477
4,878,622 11/1989 Jamison et al. ..... 251/6 X

FOREIGN PATENT DOCUMENTS 0242077 10/1987 European Pat. Off. ..... 417/477

*Primary Examiner*—John C. Fox
*Attorney, Agent, or Firm*—Barnes & Thornburg

[57] ABSTRACT

A peristaltic voltage block for use in systems for electrostatically aided atomization and dispensing of conductive coating materials includes a resilient, electrically non-conductive conduit arranged in multiple loops on a support mechanism. The voltage block also includes contactors for contacting the conduit substantially to occlude the conduit to divide coating material flowing in the conduit into discrete slugs, and a rotor supporting the contactors. A mechanism is provided for selectively moving the contactors into and out of occluding engagement with the conduit.

32 Claims, 5 Drawing Sheets

PERISTALTIC VOLTAGE BLOCK ROLLER ACTUATOR

This invention relates to peristaltic voltage blocks primarily for use in electrostatically aided systems for atomizing and dispensing conductive coating materials.

Throughout this application, the term "voltage block" is used to describe both the prior art and the devices of the invention. It is to be understood, however, that these devices function to minimize, to the extent they can, the flow of current. Such current otherwise would flow from a dispensing device maintained at high electrostatic potential through the conductive coating material being dispensed thereby to the grounded source of such coating material, degrading the electrostatic potential on the dispensing device. Attempts to prevent this by isolating the coating material supply from ground result in a fairly highly charged coating material supply several thousand volts from ground. This in turn gives rise to the need for safety equipment, such as high voltage interlocks to keep personnel and grounded objects safe distances away from the ungrounded coating material supply.

Various types of voltage blocks are illustrated and described in U.S. Pat. No. 4,878,622 and PCT/US89/02473, both of which disclosures are related to the present application, and in the references cited in those related disclosures. Those related disclosures are hereby incorporated herein by reference.

A problem with systems of the types described in those related disclosures is that, while fluid pressure can be used to drive the contacting rollers of certain devices described in those disclosures into flow-dividing orientation on the resilient flexible conduits of the voltage blocks disclosed therein, the resiliency of the flexible conduits themselves, as well as the pressures exerted on the walls of the flexible conduits by fluids being conveyed therethrough, must be relied upon to drive the contacting rollers out of flow-dividing orientation on the flexible conduits. Frequently, these restoring forces are not enough to open the lumens of the flexible conduits to their full designed cross sectional areas as rapidly as desired for efficient operation. Consequently, maximum flow rates through the conduits can be compromised, typically at times when maximum design flow rates are most desirable, such as when a solvent is being flushed at a high volume rate through the conduit to clean it during a color change and when compressed air is being blown through the conduit to dry the solvent near the end of such a cleaning cycle.

Systems for retracting or otherwise controlling the positions of peristaltic pump rollers and other types of apparatus are disclosed in, for example, U.S. Pat. Nos.: 3,787,148; 3,308,898; 4,217,062; and, 4,322,054. Attention is also directed to U.S. Pat. Nos.: 3,822,948; 4,214,681; and 3,866,678. No representation is made, nor is any representation intended, that the preceding constitutes an exhaustive listing of the pertinent prior art.

It is a primary object of the present invention to provide an improved mechanism for positioning the contactors of peristaltic devices, such as peristaltic voltage blocks.

According to the invention, a peristaltic device comprises a resilient conduit, first means for supporting multiple loops of the conduit, contactors for contacting the conduit, second means for supporting the contactors, third means for providing relative movement between the first and second means, and fourth means for selectively moving the contactors between first positions occluding the conduit and second positions out of occluding engagement with the conduit.

Illustratively, according to the invention, the moving means comprises a fluid motor and the apparatus further comprises means for delivering driving fluid to the fluid motor.

Further illustratively, the apparatus includes a number of fluid motors equal to the number of contactors.

In addition, according to illustrative embodiments of the invention, each fluid motor comprises a piston and cylinder fluid motor, the cylinder having a head.

Further illustratively, each piston and cylinder fluid motor includes a seal extending between the piston and cylinder, a chamber being defined between the piston, cylinder, and seal. According to an illustrative embodiment, each fluid motor comprises a double-acting piston and cylinder. In this embodiment, each fluid motor illustratively also includes a second seal extending between the piston and the cylinder, a second chamber being defined between the piston, the cylinder, and the first-mentioned and second seals. The first-mentioned and second chambers selectively and alternately communicate with the driving fluid delivery means to receive fluid to move the piston alternately away from and toward the head of the cylinder. This moves the contactor associated with the piston into engagement with the conduit and out of engagement with the conduit, respectively. In another embodiment, the second seal and second chamber are replaced by return springs.

Additionally, the first-mentioned seal illustratively comprises a resilient O-ring. In one embodiment, the O-ring has a somewhat U- or V-shaped transverse section.

Further illustratively, each contactor comprises a roller having an axis of rotation. In addition, according to illustrative embodiments of the invention, each piston comprises a cradle formed to support its respective contactor for rotation about its axis when the contactor is in engagement with the conduit.

The invention may be best understood by referring to the following description and accompanying drawings which illustrate the invention. In the drawings.

Figure 1:
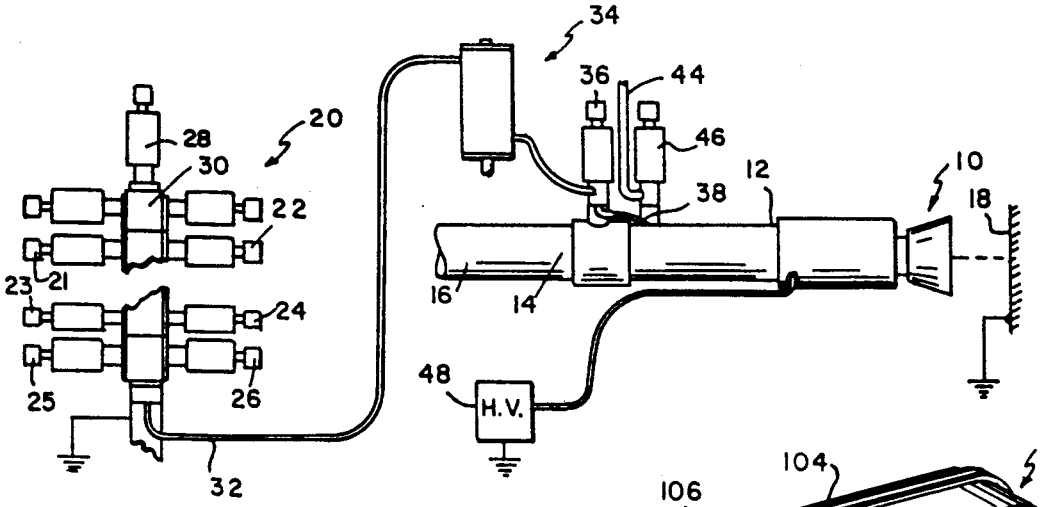
FIG. 1 illustrates a diagrammatic side elevational view of a system including a peristaltic voltage block according to the present invention.

In FIG. 1, a dispensing device 10 and some of the related electrical, liquid and pneumatic equipment for its operation are illustrated. Dispensing device 10 is mounted from one end 12 of a support 14, the other end 16 of which can be mounted to permit movement of dispensing device 10 as it dispenses coating material onto an article 18 to be coated, a "target," passing before it. Support 14 is constructed from an electrical insulator to isolate dispensing device 10 from ground potential.

The system further includes a color manifold 20, illustrated fragmentarily. Color manifold 20 includes a plurality of illustratively air operated color valves, six, 21-26 of which are shown. These color valves 21-26 control the introduction of various selected colors of coating material from individual supplies (not shown) into the color manifold 20. A solvent valve 28 is located at the head 30 of color manifold 20. A supply line 32, which is also maintained at ground potential, extends from the lowermost portion of color manifold 20 through a peristaltic voltage block 34 to a triggering valve 36 mounted adjacent dispensing device 10. A feed tube 38 is attached to the output port of triggering valve 36. A coating material flowing through a selected one of color valves 21-26 flows through manifold 20 into supply line 32, through voltage block 34, triggering valve 36, feed tube 38 and into the interior of dispensing device 10. Operation of device 10 atomizes this selected color of coating material.

For purposes of cleaning certain portions of the interior of device 10 during the color change cycle which typically follows the application of coating material to each target 18 conveyed along a grounded conveyor (not shown) past device 10, a line extends from a pressurized source (not shown) of solvent through a tube 44 and a valve 46 to device 10. Tube 44 feeds solvent into device 10 to remove any remaining amounts of the last color therefrom before dispensing of the next color begins.

The coating material dispensed by device 10 moves toward a target 18 moving along the grounded conveyor due, in part, to electric forces on the dispensed particles of the coating material. To impart charge to the particles of coating material and permit advantage to be taken of these forces, an electrostatic high potential supply 48 is coupled to device 10. Supply 48 may be any of a number of known types.

Figure 2:
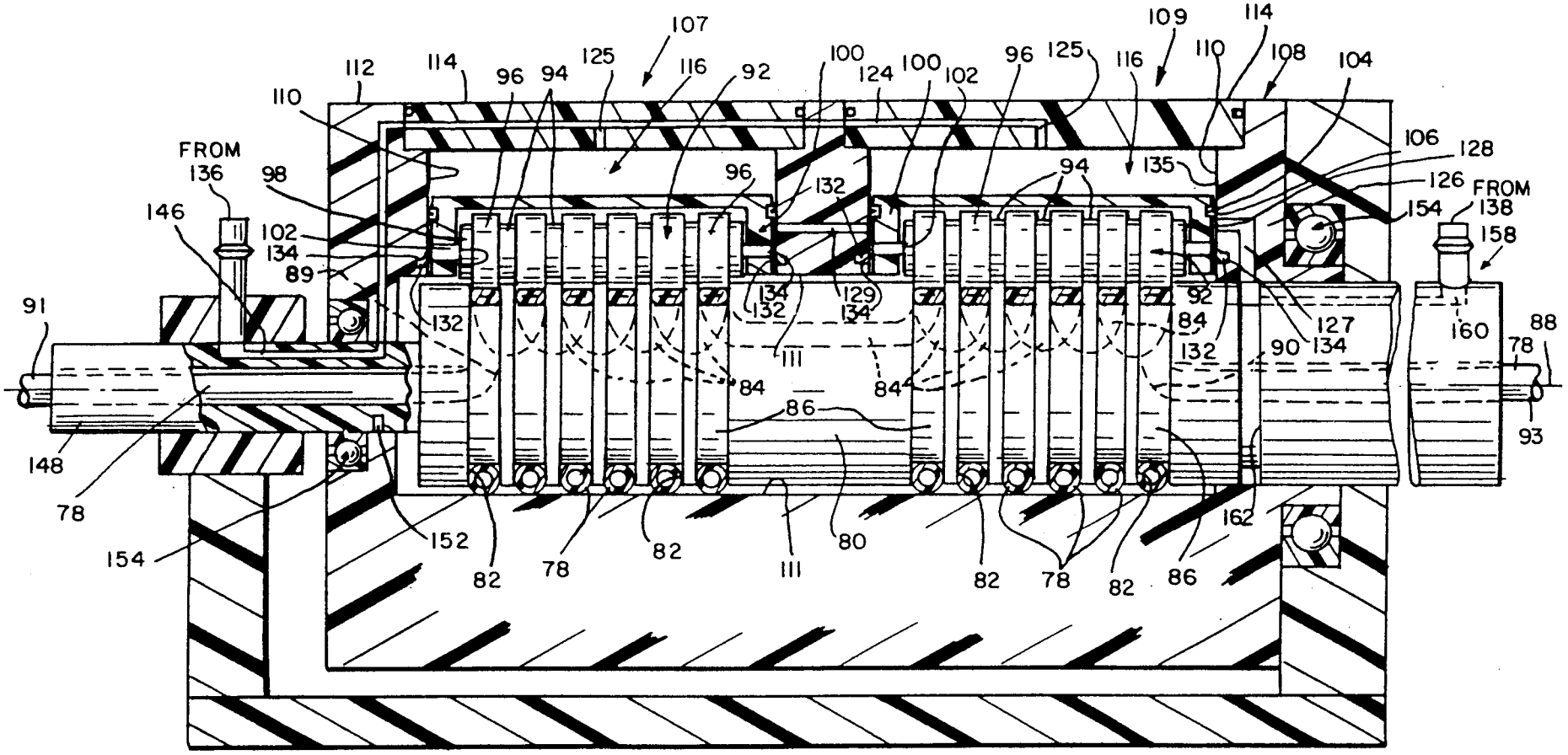
FIG. 2 illustrates a somewhat simplified sectional side elevational view of a peristaltic voltage block constructed according to the present invention.

In the embodiment of the invention illustrated in FIG. 2, a resilient conduit 78 is threaded on and through a mandrel 80. Mandrel 80 is generally right circular cylindrical in configuration, but is provided with circumferentially extending channels 82. A passageway 84 extends within the interior of mandrel 80 between the floors 86 of each adjacent pair of channels 82. Conduit 78 is wrapped into a loop in a channel 82 adjacent an end of the mandrel, passed through the passageway 84 between the floor 86 of that channel and the floor 86 of the next adjacent channel 82, wrapped into a loop in that channel 82, and so on until the channel 82 at the opposite end of the mandrel 80 is reached. Separate passageways 89, 90 are provided between the floors 86 of the end channels 82 and the axis 88 of the mandrel 80. The inlet 91 and outlet 93 ends of conduit 78 are threaded through the passageways 89, 90 respectively and out of mandrel 80 along the axis 88 thereof in opposite directions.

Rollers 92 are divided by clearance regions 94 into contacting segments 96 which contact conduit 78 in respective channels 82. Each roller 92 is rotatably mounted by its axle 98 in a respective cradle 100. Although only two rollers 92 are illustrated in FIG. 2, this is done for purposes of clarity only, and it is understood that a typical device 10 might include sixteen such rollers. Reference is here made to U.S. Pat. No. 4,878,622 and PCT/US89/02473 for a detailed explanation of such an arrangement.

Figure 4:
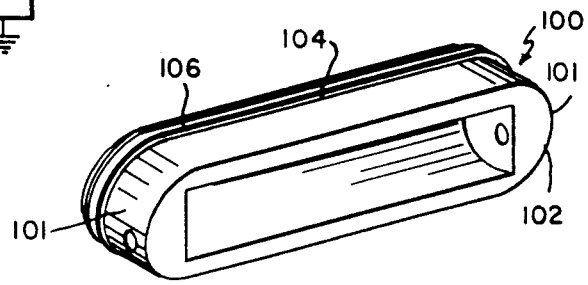
FIG. 4 illustrates a perspective view of a combination piston and cradle formed to support a contactor according to the embodiment of the invention illustrated in FIGS. 2–3.

As best illustrated in FIG. 4, cradles 100 are generally right rectangular, but with half-circular ends 101, in cross-sections perpendicular to radii from axis 88. The half-circular ends 101 are provided with holes 102 for rotatably receiving the ends of axles 98 of respective rollers 92. The outer periphery of each cradle 100 is formed to include a perimetral groove 104 for receiving a first seal 106 in the form of an O-ring having a somewhat U- or V-shaped section transverse to its longitudinal extent. As best illustrated in FIG. 2, a rotor 108 is provided with multiple longitudinally extending slots 110 in each of two axially spaced sections 107, 109 thereof. Each slot 110 has a cross sectional shape perpendicular to a radius from axis 88 substantially identical to the cross-sections of cradles 100.

Each slot 110 extends radially from the mandrel 80 axis 88 between the inner sidewall 111 of rotor 108 and the outer, generally right circular cylindrical sidewall 112 thereof. Rotor 108 fits over mandrel 80. Then cradles 100 with their respective rollers 92 rotatably mounted in them are loaded into slots 110 through the openings in sidewall 112. Slot-closing caps 114 with internal compressed air-providing galleries 124 and compressed air-supplying openings 125 close the outer ends of slots 110.

Figure 3:
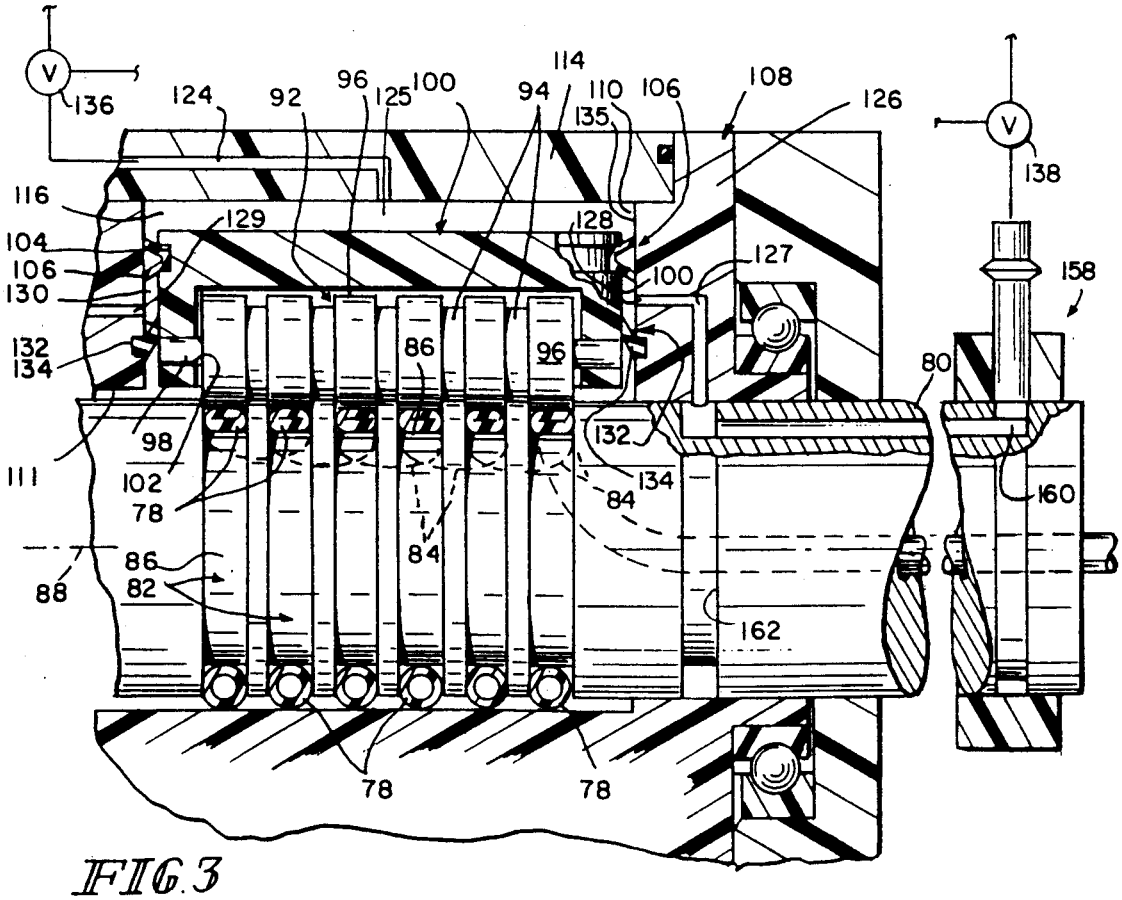
FIG. 3 illustrates an enlarged fragmentary view of the apparatus of FIG. 2.

Galleries 124 are supplied with compressed air to drive cradles 100 supporting their respective rollers 92 radially inwardly toward axis 88 of mandrel 80. As best illustrated in FIG. 3, seals 106 prevent the escape of compressed air from chambers 116 and cause cradles 100 to move radially inwardly toward axis 88 of mandrel 80 in response to the driving force supplied by the compressed air. Driving cradles 100 radially inwardly brings contacting segments 96 of rollers 92 into occluding engagement with conduit 78 in respective channels 82 to divide fluid in conduit 78 into slugs, thus providing a voltage block.

At certain times it is also important to retract rollers 92 quickly to promote free flow of fluid through conduit 78, for example, during a color change cycle. A limited roller-retracting force will be exerted by resilient conduit 78 and by the pressure of the fluid flowing therethrough on the walls thereof to open conduit 78 to its full designed cross-section. However, it is desirable to augment this retracting force by providing end wall 126 of rotor 108 with internal compressed air-providing galleries 127 having openings 128 intermediate the radially inner and outer sidewalls 111, 112, respectively, of rotor 108. The compressed air exits from openings 128 into chambers 130 defined between seals 106 and seals 132 located in perimetral grooves 134 in the sidewalls 135 of slots 110. Each seal 132 is configured somewhat like the seal of a self-adjusting disk brake piston, so as to bias its respective cradle 100 radially outwardly somewhat. This helps air pressure in chambers 130 to retract cradles 100. It also reduces the likelihood of a seal 132 being inverted and of air blowing by it. As best illustrated in FIG. 2, an intermediate gallery 129 is also provided between longitudinally adjacent chambers 130 so that the retracting force is balanced among chambers 130 of adjacent rollers 92.

The supplying of compressed air to chambers 116 and 130 and the venting of chambers 116 and 130 are complementary. That is, when compressed air is being supplied to chambers 116, chambers 130 are being vented to atmosphere, and when compressed air is being supplied to chambers 130, chambers 116 are being vented to atmosphere. A simple schematic valve diagram for achieving this function is illustrated in FIG. 5.

Figure 5:
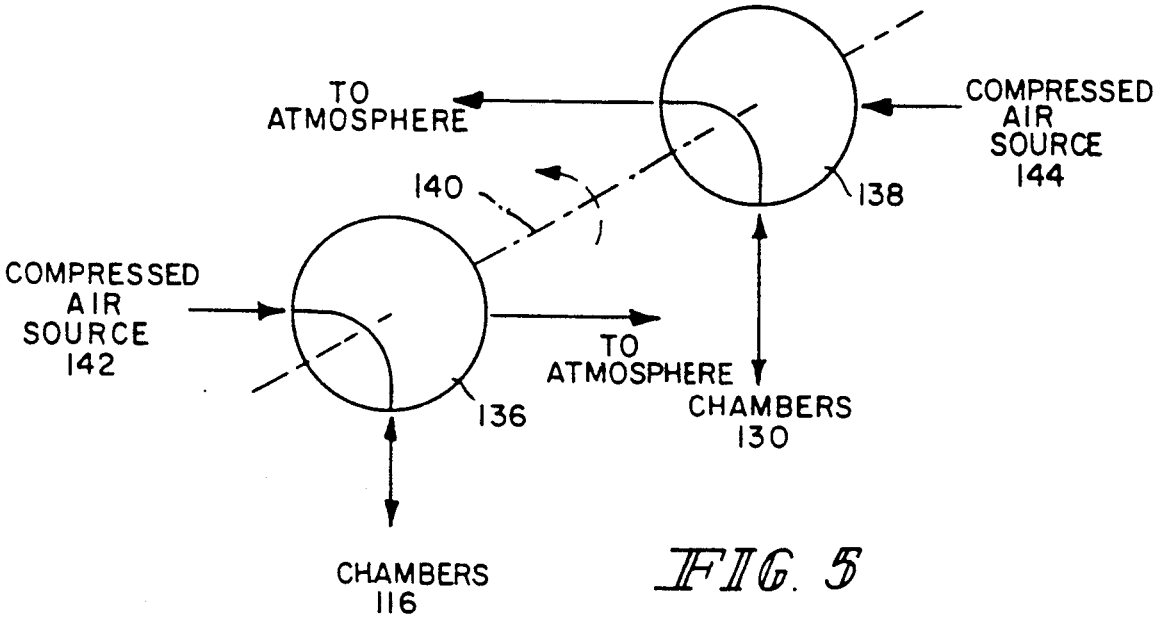
FIG. 5 illustrates a quite simplified schematic valve diagram useful in understanding the present invention.

As shown in FIG. 5, a valve 136 and a valve 138 are connected at 140 for concurrent rotation. When positioned as illustrated, valve 136 provides compressed air flow from a compressed air source 142 to chambers 116 while valve 138 vents chambers 130 to atmosphere. A 90 degree rotation of valves 136, 138 vents chambers 116 to atmosphere while concurrently providing compressed air flow from a compressed air source 144 to chambers 130.

As best illustrated in FIG. 2, valve 136 communicates with each gallery 124 and hence with each chamber 116 by way of a longitudinally extending gallery 146 in a stationary shaft 148 provided on the inlet end of mandrel 80. An annular relief 152 extends all of the way around shaft 148 to insure that valve 136 is in communication with chambers 116 regardless of rotor 108's position. In addition, an air coupler 158 provides communication between valve 138 and each chamber 130 by way of a longitudinally-extending gallery 160 and an annular relief 162 at the outlet end of mandrel 80, regardless of the rotation of rotor 108. Suitable bearings 154 rotatably mount rotor 108 from mandrel 80.

Figure 6:
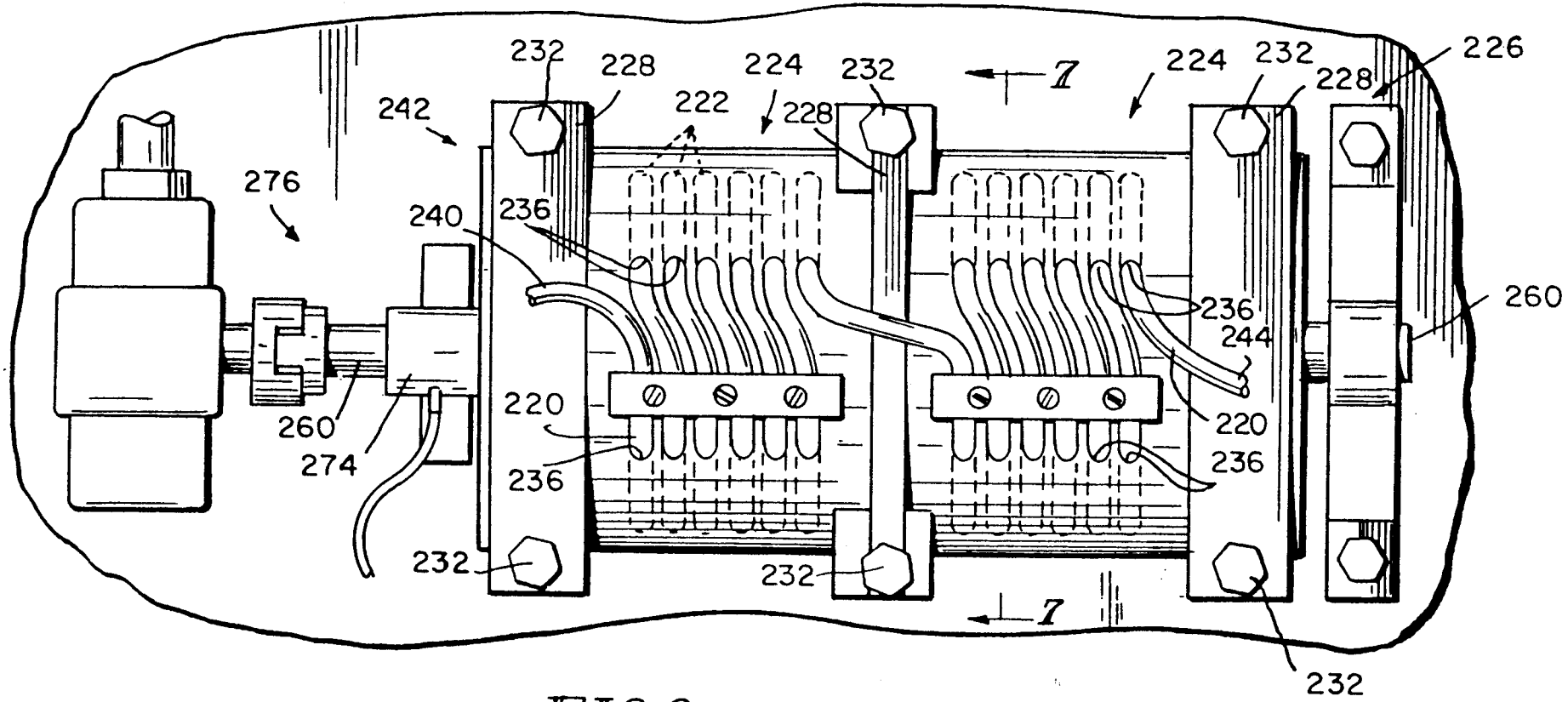
FIG. 6 illustrates a top plan view of another peristaltic voltage block constructed according to the present invention.
Figure 7:
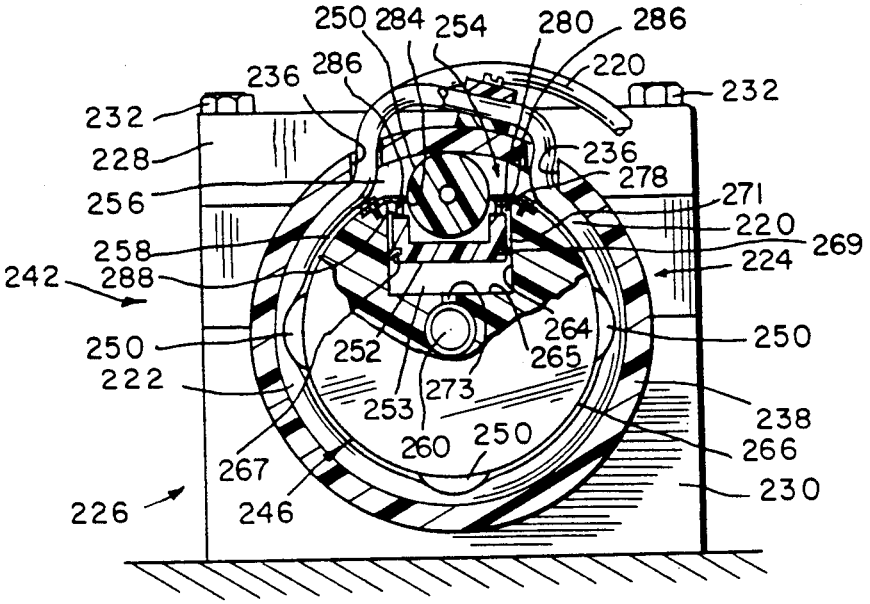
FIG. 7 illustrates a fragmentary sectional view, taken generally along section lines 7—7 of FIG. 6; and, FIG. 8 illustrates a perspective view of a combination piston and cradle formed to support a contactor according to the embodiment of the invention illustrated in FIGS. 6–7.
Figure 8:
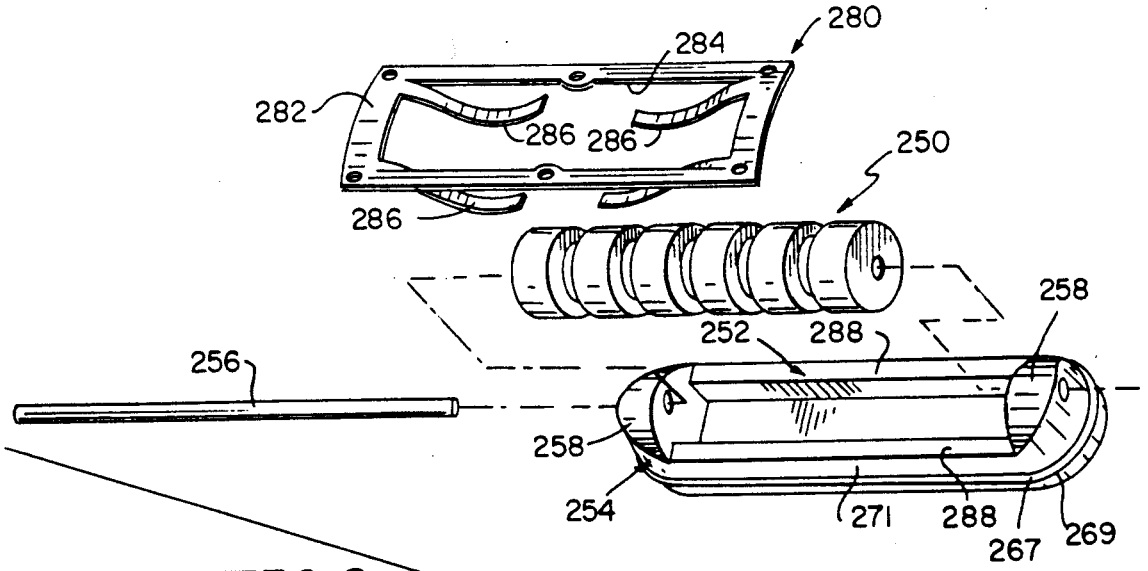

In the embodiment of the invention illustrated in FIGS. 6-8, the conduit 220 lies in planar loops 222 around the interiors of two right circular cylindrical housing cartridges 224. Cartridges 224 lie adjacent each other in end-to-end axial alignment and are held in this orientation by a framework 226 including caps 228 mounted to a block 230 by cap bolts 232. The flat loops 222 are uniformly spaced axially along cartridges 224 and each loop 222 is substantially perpendicular to the axis of its respective cartridge 224. The transfer of the largely separated slugs of coating material from one loop 222 to the next adjacent loop is achieved by threading the conduit 220 through passageways 236 provided in the sidewalls 238 of cartridges 224. The transfer of coating material from each loop 222 to the next adjacent loop 222 as the coating material flows from the inlet end 240 of device 242 to the outlet end 244 thereof takes place outside of the cartridge 224 sidewalls 238.

The rotor 246 construction illustrated in FIG. 7 is provided to speed solvent flushing of coating material from the device 242. The rollers 250 which actually contact the conduit 220 to separate the coating material in the conduit 220 into discrete slugs are rotatably mounted in elongated rectangular prism-shaped cradles 252. One long side 254 of each cradle 252 is open to receive its respective roller 250. The axles 256 of rollers 250 are rotatably mounted in the opposed short end walls 258 of cradles 252. The rotor 246 is provided with four equally spaced longitudinally extending slots 264 (only one of which is illustrated) in its outer generally right circular cylindrical sidewall 266. Slots 264 are slightly larger in length and width than cradles 252. This permits the cradles 252 to be mounted in respective slots 264 for relatively free sliding movement radially of the axle 260 of rotor 246. Each slot 264 defines a cylinder within which a respective cradle 252 is reciprocable radially of axle 260 of rotor 246. A chamber 253 is defined between the respective cradle 252 and the radially inner end, or head, 265 of its respective slot 264. An O-ring seal 267 having a configuration somewhat like the configurations of seals 132 in the embodiment of FIGS. 2-4 is provided in a groove 269 which extends circumferentially along the sidewall 271 of each cradle 252. A port 273 is provided in the head 265 of each slot 264. Compressed air is provided from a rotary air coupler 274 (FIG. 6) at the ground potential, or driven, end 276 of device 242. Each cradle 252 is held in the radially outer end 278 of its respective slot 264 by a cap 280 having an arcuately shaped outer surface 282 generally conforming to the contour of rotor 246. A plurality of, for example, electrically non-conductive plastic screws hold each cap 280 onto rotor 246 at the radially outer end of a respective slot 264. Each roller 250 protrudes through a longitudinally extending slot 284 in a respective cap 280. Four springs 286 are positioned between the outer end 288 of each cradle 252 and its respective cap 280.

When it is desired to employ the voltage blocking capacity of device 242, such as when an electrically highly conductive coating material is being supplied therethrough to a coating material atomizing and dispensing device maintained at high-magnitude electrostatic potential, compressed air is supplied through coupler 274 and ports 273 to chambers 253, forcing the rollers 250 outward and occluding conduit 220 between adjacent slugs of the conductive coating material. Rotor 246 divides the coating material substantially into electrically isolated slugs which move along conduit 220 peristaltically from inlet end 240 to outlet end 244 while maintaining a potential difference across ends 240, 244 substantially equal to the potential difference across the output terminals of the high-magnitude electrostatic potential supply.

When it is desired not to employ the voltage blocking capacity of device 242, such as when dispensing of an electrically conductive coating material is complete and the high-magnitude potential supply has been disconnected from the dispensing device in preparation for solvent flushing prior to a subsequent dispensing cycle with a different coating material, the compressed air source is disconnected from coupler 274 and the coupler is vented to atmosphere. The resiliency of conduit 220 and the pressure of the solvent in conduit 220 are aided by springs 286 acting between caps 280 and cradles 252 to urge cradles 252 and their respective rollers 250 radially inwardly, permitting the free, rapid flow of solvent through conduit 220 to flush any remaining traces of the pre-change coating material from it. Compressed air can then be passed through conduit 220 to dry it in preparation for the next dispensing cycle.

What is claimed is:

1. A peristaltic voltage block comprising a resilient, electrically non-conductive conduit, first means for supporting multiple loops of the conduit, contactors for contacting the conduit, second means for supporting the contactors, third means for providing relative movement between the first and second means, and fourth means for selectively moving the contactors between first positions occluding the conduit and second positions out of occluding engagement with the conduit.

2. The apparatus of claim 1 wherein the fourth means comprises a fluid motor and the apparatus further comprises means for delivering a driving fluid to the fluid motor.

3. The apparatus of claim 2 further comprising a number of fluid motors equal to the number of contactors.

4. The apparatus of claim 3 wherein each fluid motor comprises a piston and cylinder fluid motor, the cylinder having a head.

5. The apparatus of claim 4 wherein each piston and cylinder fluid motor comprises a first seal extending between the piston and the cylinder, a first chamber being defined between the piston, the cylinder and the first seal, and a second seal extending between the piston and the cylinder, a second chamber defined between the piston, the cylinder and the first and second seals, the first and second chambers selectively and alternately communicating with the driving fluid delivery means to receive fluid to move the piston alternately away from and toward the head of the cylinder to move the contactor associated with the piston into engagement with the conduit and out of engagement with the conduit, respectively.

6. The apparatus of claim 5 wherein the second seal comprises a resilient O-ring.

7. The apparatus of claim 6 wherein each piston is formed to include a perimetral groove for receiving the seal.

8. The apparatus of claim 5 wherein the delivery means comprises a delivery channel communicating with the chamber.

9. The apparatus of claim 8 wherein the second means is formed to include the delivery channel.

10. The apparatus of claim 5 wherein the delivery means comprises a first delivery channel communicating with the first chamber and a second delivery channel communicating with the second chamber.

11. The apparatus of claim 10 wherein the second means is formed to include the first and second delivery channels.

12. The apparatus of claim 4 wherein each piston and cylinder fluid motor comprises a seal extending between the piston and the cylinder, a chamber being defined between the piston, the cylinder and the seal, the second means including a cap for retaining each piston in its respective cylinder and spring means disposed between the cap and the piston for urging the piston toward the cylinder head.

13. The apparatus of claim 12 wherein the seal comprises a resilient O-ring.

14. The apparatus of claim 13 wherein each piston is formed to include a perimetral groove for receiving the seal.

15. The apparatus of claim 12 wherein the delivery means comprises a delivery channel communicating with the chamber.

16. The apparatus of claim 15 wherein the second means is formed to include the delivery channel.

17. The apparatus of claim 4 wherein each contactor comprises a roller having an axis of rotation.

18. The apparatus of claim 17 wherein each piston comprises a cradle formed to support its respective contactor for rotation about the contactor's axis when the contactor is in engagement with the conduit.

19. The apparatus of claim 4 wherein the second means is formed to include the cylinders.

20. The apparatus of claim 1 wherein the first means comprises means for supporting the loops of conduit in substantially parallel planes substantially perpendicular to an axis of relative rotation between the first and second means with lengths of conduit extending between adjacent planes to connect adjacent loops of conduit to each other.

21. A peristaltic device comprising a resilient conduit, first means for supporting multiple loops of the conduit, contactors for contacting the conduit, a second means for supporting the contactors, third means for providing relative rotation between the first and second means, and fourth means for selectively moving the contactors between first positions occluding the conduit and second positions out of occluding engagement with the conduit while the first and second means relatively rotate.

22. The apparatus of claim 21 wherein the moving means comprises a fluid motor and the apparatus further comprises means for delivering a driving fluid to the fluid motor.

23. The apparatus of claim 22 further comprising a number of fluid motors equal to the number of contactors.

24. The apparatus of claim 23 wherein each fluid motor comprises a piston and cylinder fluid motor, the cylinder having a head.

25. The apparatus of claim 24 wherein each piston and cylinder fluid motor comprises a first seal extending between the piston and the cylinder, a first chamber being defined between the piston, the cylinder and the first seal, and a second seal extending between the piston and the cylinder, a second chamber defined between the piston, the cylinder and the first and second seals, the first and second chambers selectively and alternately communicating with the driving fluid delivery means to receive fluid to move the piston alternately away from and toward the head of the cylinder to move the contactor associated with the piston into engagement with the conduit and out of engagement with the conduit, respectively.

26. The apparatus of claim 24 wherein each contactor comprises a roller having an axis of rotation.

27. The apparatus of claim 26 wherein each piston comprises a cradle formed to support its respective contactor for rotation about its axis when the contactor is in engagement with the conduit.

28. The apparatus of claim 24 wherein each piston and cylinder fluid motor comprises a seal extending between the piston and the cylinder, a chamber being defined between the piston, the cylinder, and the seal, the second means including a cap for retaining each piston in its respective cylinder and spring means disposed between the cap and the piston for urging the piston toward the cylinder head.

29. The apparatus of claim 28 wherein the seal comprises a resilient O-ring.

30. The apparatus of claim 29 wherein each piston is formed to include a perimetral groove for receiving the seal.

31. The apparatus of claim 28 wherein the delivery means comprises a delivery channel communicating with the chamber.

32. The apparatus of claim 31 wherein the second means is formed to include the delivery channel.

* * * * *